US005135365A

United States Patent [19]

Bogage

[11] Patent Number: 5,135,365

[45] Date of Patent: Aug. 4, 1992

[54] WATERPROOF OVERHEAD FAN

[75] Inventor: Gerald I. Bogage, Miami, Fla.

[73] Assignee: Leading Edge, Inc., Miami, Fla.

[21] Appl. No.: 736,697

[22] Filed: Jul. 26, 1991

[51] Int. Cl.[5] ..... F04D 29/08

[52] U.S. Cl. ..... 417/423.15; 416/5; 416/244 R; 417/424.1

[58] Field of Search ..... 417/423.15, 424.1, 572; 416/5, 247 R, 170 C, 244 R; 277/212 F; 310/89

[56] References Cited

U.S. PATENT DOCUMENTS 3,033,049 5/1962 Morrow ..... 416/5 X
4,592,702 6/1986 Bogage ..... 416/247 R
4,729,725 3/1988 Markwarot ..... 417/424.1 X

*Primary Examiner*—Leonard E. Smith
*Attorney, Agent, or Firm*—Anthony A. O'Brien

[57] ABSTRACT

An overhead suspended fan has a canopy with a top seal on a support shaft and a bottom seal which is mounted on a rim of a cup-shaped member supported above the motor housing bearing and which has an annular portion engaging the inside of the bottom portion of the canopy and an open shoulder upon which the bottom end of the canopy rests; an inner lip on the annular portion of the bottom seal defines a groove interlocking with the rim of the annular member. An outward and downward flaring skirt on the second seal forms a narrow restricted clearance with a frustoconical portion of the motor housing; a second cup-shaped member mounted on the top portion of the housing has a rim extending upward within a depending annulus of the second seal to prevent water flow to the housing bearing.

8 Claims, 2 Drawing Sheets

WATERPROOF OVERHEAD FAN

TECHNICAL FIELD

The present invention relates to overhead fans and in particular, to such fans which are protected against damage by water streams.

BACKGROUND OF THE PRIOR ART

In industrial and agricultural applications, overhead suspended fans can be subject to water damage from water streams used to wash interior building surfaces or equipment, from roof leakage, or from other water streams which may impinge on the fan housing. U.S. Pat. No. 4,592,702, issued on Jun. 3, 1986, for WATERPROOF FAN, which is incorporated herein by reference in its entirety, discloses upper and lower seals on a canopy which covers electrical wiring, electrical controls and the entrance to the rotatable motor housing for the fan. While the patented water protected fans have been a substantial success, the present invention relates to an improvement thereof.

SUMMARY OF THE INVENTION

The present invention is summarized in an overhead suspended fan having a lower canopy seal which is mounted at its interior on a rim of a cup-shaped support disc extending upward inside the bottom edge of a canopy skirt. The lower canopy seal has an annular portion engaging the inside surface of a bottom edge portion of the canopy skirt and has an outer open shoulder for engaging the bottom edge of the canopy skirt. A skirt on the lower canopy seal extends outward and downward over the upper side of a motor housing rotatably mounted on fan support shaft.

An object of the invention is to construct a more cost effective overhead suspended fan with substantially improved and longer lasting protection from water entry and damage.

It is another object of the invention to construct a seal structure with improved ease of assembly with less tendency for being subject to mis-assembly and loss of water protection.

One advantage of the invention is that a cup-shaped interior disc supports a lower seal which has an outer surface extending in sealing engagement with the interior of the lower end to a canopy, has an outer open shoulder upon which the lower end of the canopy can rest, and has a depending skirt for reliably protecting a suspended motor housing from water entry.

Other features of the invention include the provision of an interlocking annular groove in the bottom of an inside lip of a lower seal for receiving and interlocking with the rim of a cup-shaped disc support for the seal; and interior depending annulus spaced inside of an exterior depending skirt on a lower seal; and a second cup-shaped disc: mounted on the top of a rotatable motor housing and having its rim extending upward inside of a lower seal extending over the upper end of the motor housing to further arrest water entry.

Other objects, advantages and features of the invention will be apparent from the following description taken in conjunction with the accompanying drawings.

DETAILED DESCRIPTION

Figure 1:
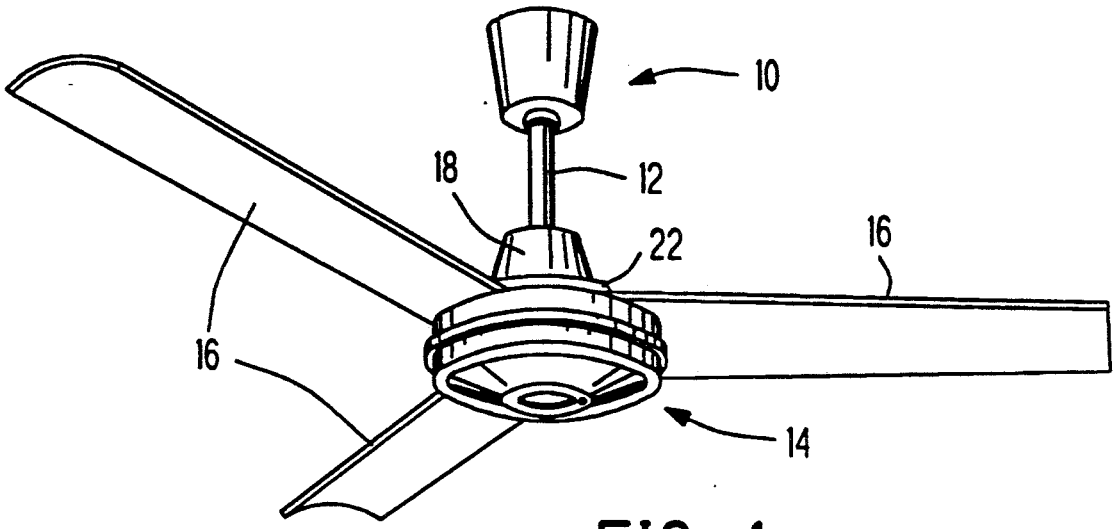
FIG. 1 is a perspective view of a suspended overhead fan constructed in accordance with the invention.
Figure 3:
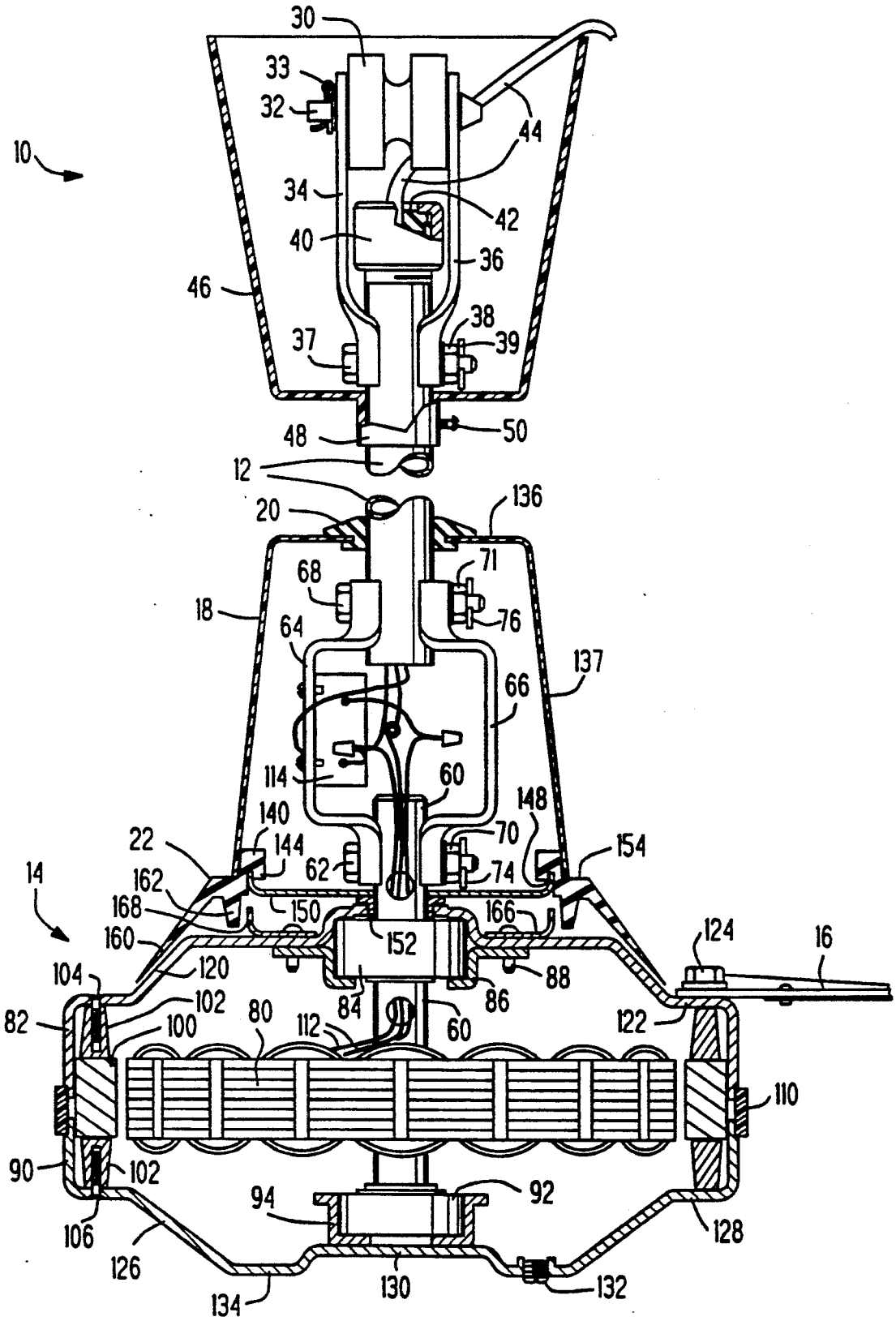
FIG. 3 is an elevational view, partially in section and with parts broken away, of the fan of FIG. 1.

As shown in FIGS. 1 and 3, an overhead suspended fan in accordance with the invention includes an upper mounting structure generally indicated at 10, a hollow support shaft 12 depending from the upper mounting structure, a motor assembly indicated generally at 14 mounted at the lower end of the shaft, fan blades 16 mounted on the motor assembly, and a canopy 18 with an upper seal 20 and a lower seal 22 protecting the fan motor from any water which may impinge upon the fan.

The upper mounting structure 10 includes a rubber bushing 30 secured by a mounting pin 32 and a cotter pin 33 between the upper ends of arms 34 and 36 cf a supporting yoke. In a prior art structure, this supporting yoke was U-shaped with a threaded annulus formed in the bottom of the U-shaped yoke screwed onto the upper end of the support shaft 12. The arms 34 and 36 are separate members which are mounted at their lower ends by a bolt 37 on the upper end of the hollow shaft 12. The nut 38 of the bolt 37 is prevented from vibrating off by a cotter pin 39. The bushing 30, similar to the patented bushing, has an annular groove for fitting on a hook (not shown) on the lower end of a support rod (not shown) mounted on a ceiling, overhead beam, or other overhead building structure. Alternatively, any other suitable arrangement for mounting the fan on a ceiling or an overhead structure can be used.

Similar to the prior art, a nut 40 is threaded on the upper end of the shaft 12 and secures a rubber grommet 42 to form a water tight seal around the electrical cable 44 extending through the shaft 12 to supply electrical power to the fan motor. A generally inverted bell-shaped plastic canopy 46 with an integral mounting collar 48 is secured to the shaft 12 by a set screw 50 to cover the lower side of the mounting structure.

The motor assembly 14 has a hollow motor shaft 60 secured by a bolt 62 to the lower ends of yoke members 64 and 66 which are mounted at their upper ends by a bolt 68 on the lower end of the support shaft 12. Nuts 70 and 71 on the respective bolts 62 and 68 are locked by cotter pins 74 and 76 against being released by vibration. A motor stator 80 is fixed on the shaft 60. Upper motor housing 82 is rotatably mounted on the shaft 60 by a ball bearing 84 which is secured by ring member 86 and bolts 88 to the upper motor housing 82. Lower motor housing 90 is rotatably mounted on the lower end of the motor shaft 60 by a ball bearing 92 engaged in cup member 94 fixed on the lower housing. Rotor 100 is mounted by brackets 102 and bolts 104 and 106 to the upper and lower housings 82 and 90 in the proper position around the stator 80. The brackets 102 and bolts 104 and 106 also fasten the upper and lower motor housings 82 and 90 together. Outer annular ring 110 covers and seals the seam between the upper and lower housings.

Wires 112 connected to the stator windings pass through an opening into the hollow shaft 60 below the bearing 84 and exit through an opening above the bearing 84 where the wires 112 are connected to a capacitor 114 and the wires of the power supply cable 44 for operating the motor in a conventional manner. The capacitor 114 is mounted on the yoke member 64. Conveniently the wire connections can be readily positioned within the central cavity defined by the yoke members 64 and 66.

The top of the upper housing 82 has a generally frustoconical central portion 120 which protrudes above a generally flat horizontal annular portion 122 upon which the blades 16 are fastened by bolts 124. The bottom of the lower housing 90 has an inverted frustoconical center portion 126 protruding below a flat horizontal annular portion 128. The flat annular portions 122 and 128 provide the mounting surfaces for the brackets 102 supporting the rotor 100. A raised central portion 130 in the bottom of the lower housing 90 supports the cup member 94 and bearing 92. A porous plug 132 closes an opening in the central lower annulus 134 surrounding the central portion 130 to provide a drain for any condensation or other moisture which may collect in the motor housing.

The canopy 18 and the upper seal 20 are similar to a prior art canopy and upper seal. The canopy 18 is a hollow truncated cone of plastic material having an annular top 136 and a skirt 137 extending from the canopy top downward and outward to cover the yoke members 64 and 66 and the upper end of the motor shaft 60. The seal 20 is a rubber grommet tightly fitted on the shaft 12 and tightly fitted in the center opening of the annular top 136 of the canopy 18 to prevent water from passing through the upper canopy opening around the shaft 12.

Figure 2:
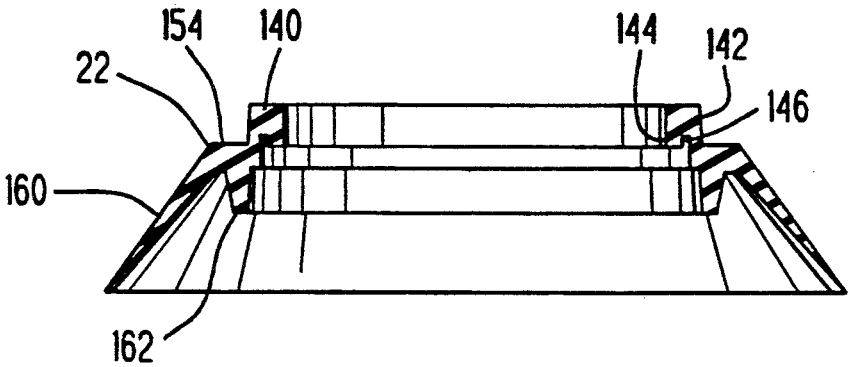
FIG. 2 is an elevational section view of a lower seal for a canopy of the fan of FIG. 1.

The lower seal 22, however, differs substantially from the prior art seal which is shown in U.S. Pat. No. 4,592,702. The seal 22, as shown in FIGS. 2 and 3, has upper inner annular portion 140 defining an outer cylindrical wall 142 engaging the inner surface of the lower end portion of the canopy skirt 137. A lip 144 on the portion 140 defines an annular groove 146 receiving and interlocking with a rim 148 of a cup-shaped mounting disc 150 which is fixed, such as by spot welding, on the top of an annular spacer 152 extending on the shaft 66 upward from the bearing 84. The upper edge of the rim 148 extends above the lower edge of the canopy 18 which engages an open outer shoulder 154 of the seal 22. The cup-shaped disc 150 replaces upper and lower flat discs in the prior art; only the lower flat disc is illustrated in the U.S. Pat. No. 4,592,702 but the prior art upper disc engaged the upper surface of the annulus identified by the numeral "72" in the patent. The open shoulder 154, as opposed to the inner and outer sealing lips of the U.S. Pat. No. 4,592,702, provides substantially easier assembly since the lower end of the canopy 18 more readily assembles over the inner annulus 140 compared to insertion between the lips of the patent seal. Further the present seal arrangement has less tendency to be mis-assembled which in the prior art could result in water entry between the canopy and the lower seal.

The seal 22 also includes a skirt 160 which flares outward and downward over the frustoconical portion 120 of the upper housing 82 to form a narrow elongated frustoconical clearance between the seal 22 and the rotating housing to substantially reduce any water flow between the seal and the housing 82. A depending annulus 162 of the seal 22 is spaced inside of the skirt 160 and extends downward toward the upper surface of the housing 82 to deflect downward any stream of water entering under the skirt 160. A cup-shaped member 166 is mounted by the bolts 88 on the upper housing 82 and has its rim 168 extending upward inside and above the lower end of the depending annulus 162 to prevent any water from passing to the central opening of the housing 82.

The above arrangement is particularly advantageous in overhead fan installations that require water protected constructions. For example, in barns, factories, auditoriums, arenas and the like that are cleaned or washed down with water hoses or with overhead water sprinklers, the present overhead fan construction provides such water protection construction. The present fan has particular use in large chicken houses where overhead fans are needed to distribute heated air in the winter time and cooled air in the summer time. The need for regular cleaning of a chicken house is most efficiently accomplished by hosing down its interior surfaces. The present sealed overhead fan construction prevents water from entering and damaging the overhead fan.

Inasmuch as the present invention is subject to many variations, modifications and charges in detail, it is intended that all matter contained in the foregoing description or shown on the accompanying drawings shall be interpreted as illustrative and not in a limiting sense.

I claim:

1. A water protected overhead fan comprising:

mounting means including vertical hollow shaft means adapted to support the fan in a suspended manner;

an electrical motor having a stator fixed on the shaft means, a housing enclosing the motor, bearing means in a top portion of the housing for rotatably mounting the housing on the shaft means, and a rotor mounted in the housing and extending around the stator for rotating the housing when the stator is energized;

said top portion of the housing including a frustoconical portion;

fan blades extending from the housing;

electrical wiring extending through the hollow shaft means for connecting electrical power to the motor stator;

a canopy having a canopy top with an opening through which the support shaft extends, said canopy having a canopy shirt extending downward from the canopy top over the bearing means and the top portion of the motor housing;

a first seal sealing the opening in the canopy top to the support shaft to prevent water entry into the canopy;

a first cup-shaped disc surrounding the shaft means above the bearing means and having a rim extending upward inside the bottom edge of the canopy skirt;

a second seal having (a) an annular portion including an inner lip defining an annular groove interlocking with the rim of the first cup-shaped disc so that an outer surface of the annular portion engages the inside surface of a bottom edge portion of the canopy skirt, (b) an open shoulder engaging the bottom edge of the canopy skirt, (c) a seal skirt extending outward and downward from the open shoulder in close tolerance to the frustoconical portion of the housing to form a restricted frustoconical clearance, and (d) a depending annulus spaced inside the seal skirt for deflecting downward any water streams passing under the skirt; and a second cup-shaped disc mounted on the top portion of the housing and having a rim extending upward inside the depending annulus of the second seal for preventing water flow to the bearing means.

2. A water protected overhead fan comprising:

mounting means including vertical hollow shaft means adapted to support the fan in a suspended manner;

an electric motor having a stator fixed on the shaft means, a housing enclosing the motor, bearing means in a top portion of the housing for rotatably mounting the housing on the shaft means, and a rotor mounted in the housing and extending around the stator for rotating the housing when the stator is energized;

fan blades extending from the housing for rotation therewith;

electrical wiring extending through the hollow shaft means for connecting electrical power to the motor stator;

a canopy having a canopy top with an opening through which the support shaft extends, said canopy having a canopy skirt extending downward from the canopy top over the bearing means and the top portion of the motor housing;

a first seal sealing the opening in the canopy top to the support shaft to prevent water entry into the canopy;

a cup-shaped disc surrounding the shaft means above bearing means and having a rim extending upward inside the bottom edge of the canopy skirt; and a second seal mounted on the rim of the cup-shaped disc, said second seal having an annular portion engaging the inside surface of a bottom edge portion of the canopy skirt, an open shoulder engaging the bottom edge of the canopy skirt, and a seal skirt extending outward and downward from the open shoulder over the top portion of the housing.

3. A water protected overhead fan as claimed in claim 2 wherein the top portion of the housing includes a frustoconical portion which extends upward in close tolerance inside the skirt of the second seal to form a restricted frustoconical clearance.

4. A water protected overhead fan as claimed in claim 2 wherein the annular portion of the second seal includes an inner lip defining an annular groove interlocking with the rime of the cup-shaped disc.

5. A water protected overhead fan as claimed in claim 2 including a second cup-shaped disc mounted on the top portion of the housing and having a rim extending upward inside the skirt of the second seal for preventing water flow under the skirt to the bearing means.

6. A water protected overhead fan as claimed in claim 5 wherein the second seal has a depending annulus spaced inside the seal skirt but outside the rim of the second cup-shaped disc for deflecting downward any water streams passing under the skirt.

7. A water protected overhead fan as claimed in claim 6 wherein the top portion of the housing includes a frustoconical portion which extends upward in close tolerance inside the skirt of the second seal to form a restricted frustoconical clearance.

8. A water protected overhead fan as claimed in claim 6 wherein the annular portion of the second seal includes an inner lip defining an annular groove interlocking with the rim of the annular support member.

* * * * *